United States Patent [19]

McCall

[11] 4,214,512

[45] Jul. 29, 1980

[54] DROP CEILING AIR DIFFUSER WITH HORIZONTAL DISCHARGE PATTERN

[75] Inventor: Francis L. McCall, Hacienda Heights, Calif.

[73] Assignee: Specified Ceiling Systems, Alhambra, Calif.

[21] Appl. No.: 941,223

[22] Filed: Sep. 11, 1978

[51] Int. Cl.[2] ..... F24F 13/06

[52] U.S. Cl. ..... 98/40 D; 98/40 V; 98/40 C; 52/474

[58] Field of Search ..... 98/40 D, 40 DL, 40 B, 98/40 C; 34/229, 231; 52/474

[56] References Cited

U.S. PATENT DOCUMENTS

| | | | |
|---|---|---|---|
| 2,804,007 | 8/1957 | Kurth | 98/40 B |
| 3,688,680 | 9/1972 | Lambert | 98/40 D |
| 3,985,068 | 10/1976 | Herb | 98/40 D |

FOREIGN PATENT DOCUMENTS

| | | | |
|---|---|---|---|
| 47254 | 3/1937 | France | 98/40 B |

*Primary Examiner*—Albert J. Makay
*Assistant Examiner*—Henry Bennett
*Attorney, Agent, or Firm*—Christie, Parker & Hale

[57] ABSTRACT

An air diffuser for use in drop ceiling construction is described in which a discharge air pattern extending substantially parallel to the surface of the ceiling is achieved. The air diffuser comprises a hood forming a plenum chamber with a plurality of parallel elongated ceiling panels which are spaced apart to form slotted discharge openings. The elongated edges of the panels are formed in an arc which is tangential with the flat ceiling defining surfaces of the panels. A deflector member is secured along one curved edge of each panel, the deflector being curved in a reverse direction and extending in overlapping relationship to the opening between the panels. Air from the plenum chamber follows the contour of the deflector and around the curved edge of the adjoining panel, discharging along the flat ceiling forming surface of the panel.

7 Claims, 6 Drawing Figures

DROP CEILING AIR DIFFUSER WITH HORIZONTAL DISCHARGE PATTERN

FIELD OF THE INVENTION

The present invention relates to an integrated air diffuser for drop ceiling construction.

BACKGROUND OF THE INVENTION

The use of integrated air diffusers in combination with various forms of drop ceiling construction is well known. An integrated air diffuser for use with acoustic tile-type ceilings is described, for example, in my copending application Ser. No. 780,237, filed Mar. 22, 1977, now U.S. Pat. No. 4,135,441 entitled "Integrated Air Diffuser". In most such air diffuser designs, some means is provided to direct the flow of air discharged into the room in a particular pattern. Thus it is desirable that air flow extend substantially parallel to the ceiling and down the walls to avoid drafts and to obtain the desired heat distribution.

SUMMARY OF THE INVENTION

The present invention is directed to an air diffuser for integration with a drop ceiling of the type using a plurality of parallel metal panels which are mounted with gaps forming elongated slots between the adjacent panels through which air can be discharged into the room. Because the shape and size of the discharge slots is fixed by the design of the ceiling panels, it has been difficult to design an integrated air diffuser mounted above the panels which provides the desired horizontal discharge path for the air entering the room. Directional weirs to control the throw of air have been installed above the ceiling panels and have edges which project into the slots against which the air passing through the slots impinges. The projecting edges deflect the air to one side or the other. Such an arrangement, however, acts to restrict the air stream, and the air impinging on the deflecting surface produces turbulence and air noise.

The present invention provides an improved integrated air diffuser for a slotted metal panel ceiling in which the air exits from the slots along a path which extends substantially parallel to the ceiling surface. The present invention utilizes the principle that air moving along a surface tends to follow along and adhere closely to the surface even though the surface curves in a convex manner.

In brief, the present invention provides an integrated air diffuser for a drop ceiling constructed of a plurality of long, narrow ceiling panels which are spaced apart leaving slots between adjacent panels. The longitudinal edges of the panels are curved upwardly at the margins of the slots between the panels. The present invention utilizes deflector members removably attached to the curled edges of the panels, the deflector members extending up into an air plenum chamber formed by a hood above the panels. Each deflector member forms a smooth continuous surface with the surface of the associated panel. The surface of the deflector member is tangent to the curved edge of the associate panel and extends upwardly through a curved region which is reversed from the curved edge of the panel. The deflector member terminates in a horizontal surface extending above and overlapping the air discharge slot. Air leaving the plenum chamber flows along the reverse curve concave surface formed by the deflector member, and then downwardly and around the convex curved edge of the ceiling panel, exiting the slot along the horizontal surface formed by the ceiling panel. There is no edge or lip projecting into the slot which interferes or in any way tends to deflect or impede the smooth flow of air as it adheres to the surfaces of the deflector member and the associated ceiling panel.

DESCRIPTION OF THE DRAWINGS

For a better understanding of the invention reference should be made to the accompanying drawings, wherein.

DETAILED DESCRIPTION

Figure 1:
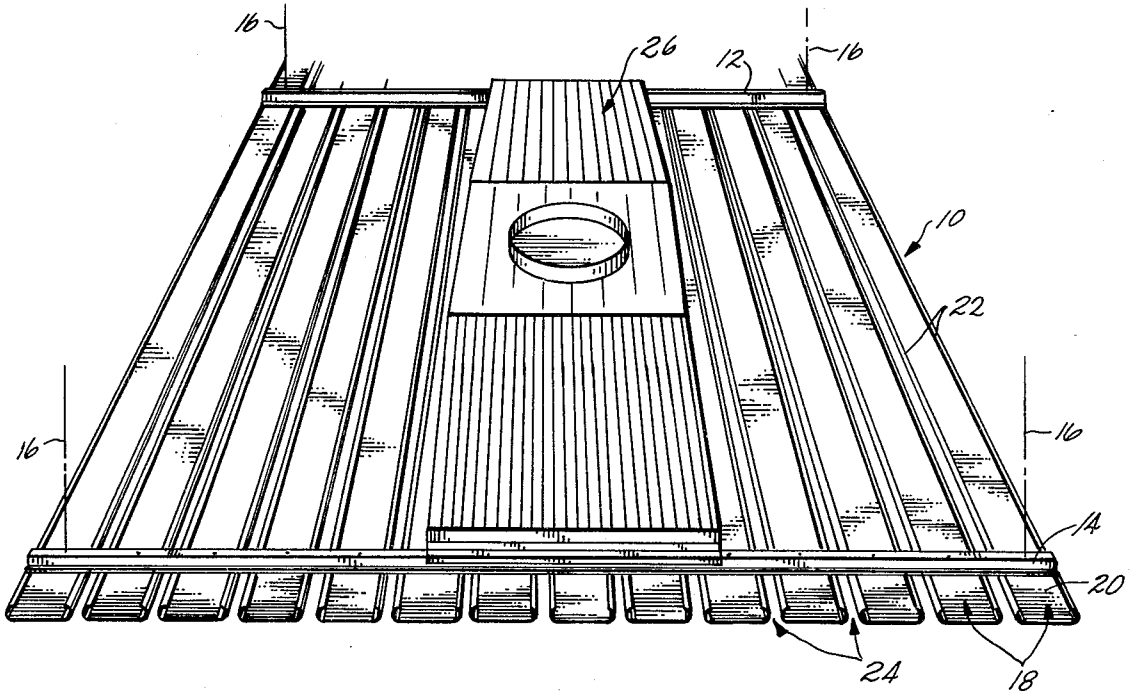
FIG. 1 is a perspective view of a typical drop ceiling construction showing an integrated air diffuser.
Figure 2:
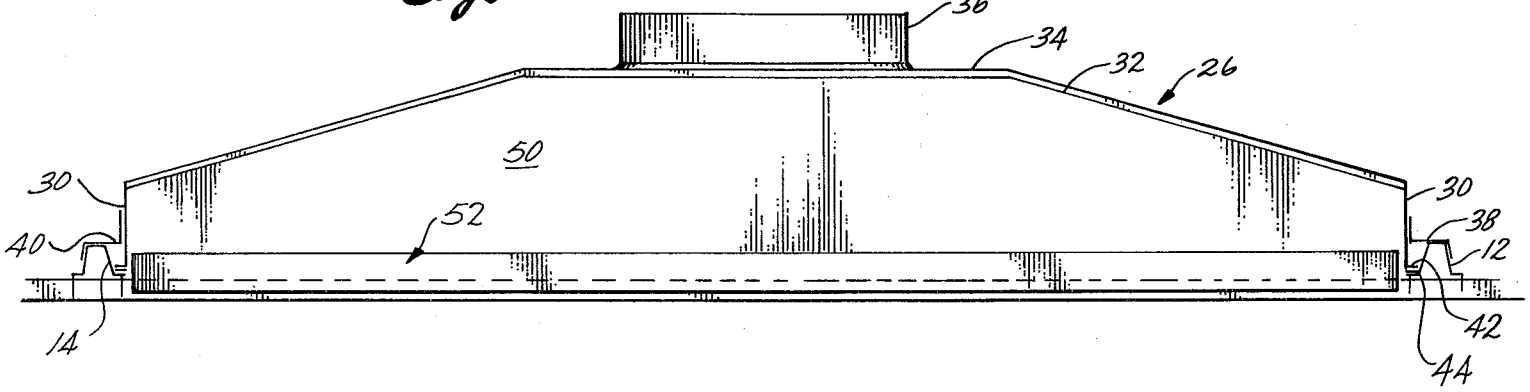
FIG. 2 is a longitudinal sectional view of the air diffuser.

Referring to the drawings in detail, the numeral 10 indicates generally a drop ceiling which is constructed from a plurality of parallel frame members, two of which are indicated at 12 and 14 and are suspended on wires or hangers in conventional manner. Extending between the frame members 12 and 14 are a plurality of narrow elongated ceiling panels 18, which may be made of rolled sheet metal or extruded aluminum. The panels are formed with a flat central portion 20, the flat portions 20 of the ceiling panels lying in a common plane which defines the finished drop ceiling surface. The longitudinal parallel edges 22 of the panel member 18 are turned up to form cylindrical surfaces tangential to the planar surface of the central portion 20 of each panel member. The edges are turned up through an arc of greater than 90° and less than 180°, as best seen in detail in FIG. 4. The panel members are spaced apart so as to leave a gap or slot 24 between the curved edges 22 of adjacent ceiling panels. As thus far described, the ceiling construction represents a conventional drop ceiling presently available on the market.

To provide an integrated air diffuser, a hood 26 is provided made of sheet metal, fiberglass, or other suitable material which is generally rectangular in shape having a pair of side walls 28 and end walls 30. A top wall 32 has a substantially horizontal center section 34 having an opening for receiving air through connecting duct work (not shown). A collar 36 is provided on the center section 34 for forming a telescoping connection with such duct work.

The hood is supported between the frame members 12 and 14 by suitable brackets 38 and 40 secured to the end walls 30 and resting on top of the frame members 12 and 14. The end walls 30 terminate in a flange 42 which is sealed to the frame members 12 and 14 by suitable compressible gasket material, as indicated at 44. Similarly the side walls 28 terminate in a flange 46 which seals with the top surface of the ceiling panels 18 by suitable gaskets 48. Thus the hood 26 forms an enclosed plenum chamber 50. Air escapes from the plenum chamber through the elongated slots 24 between the ceiling panels 18.

Figure 3:
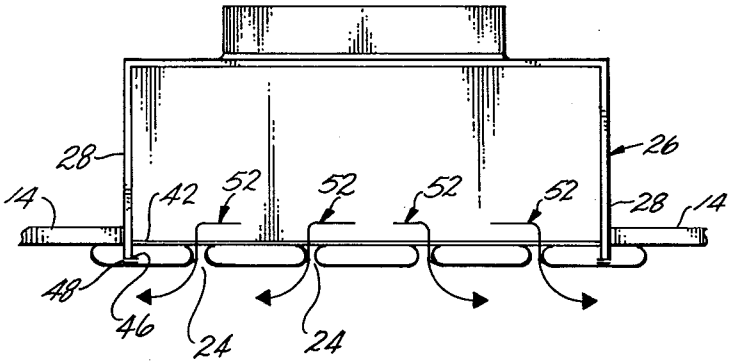
FIG. 3 is a cross-sectional view of the air diffuser.
Figure 4:
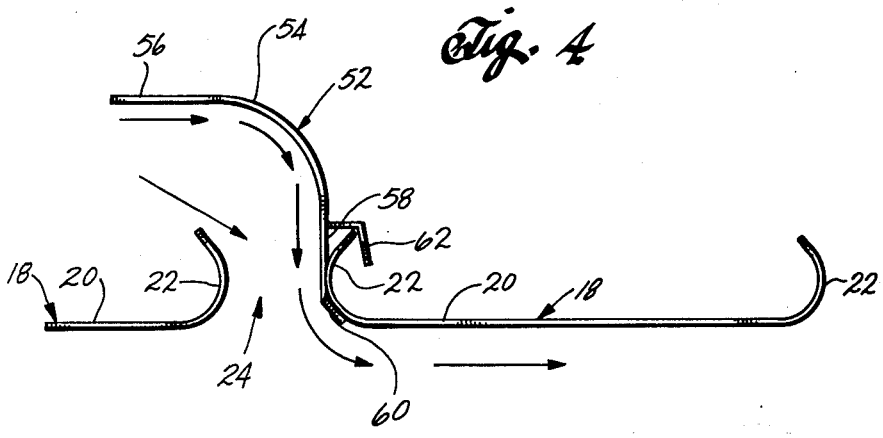
FIG. 4 is a detailed cross-sectional view showing the air pattern control.
Figure 5:
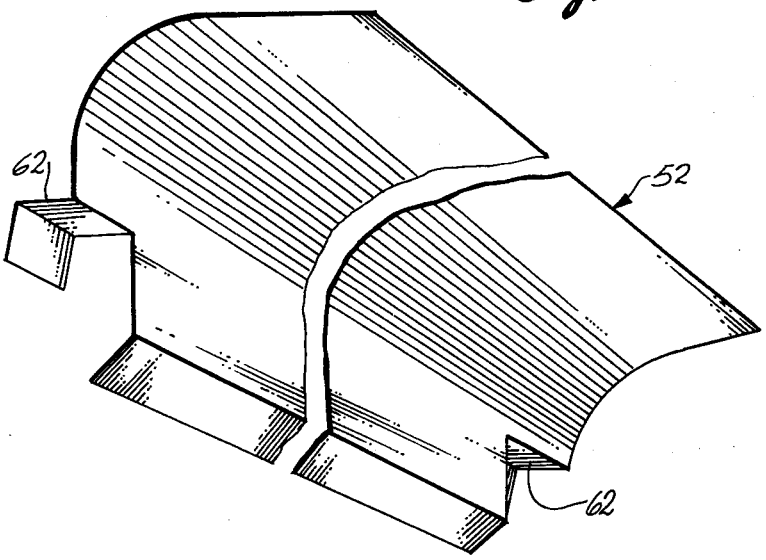
FIG. 5 is a perspective view of the deflector member used in controlling the air pattern.

According to the present invention, air escaping through the slots 24 is caused to discharge into the room in a direction substantially parallel to the ceiling surface formed by the ceiling panels. This air pattern control is provided by a plurality of deflector members 52 positioned within the plenum chamber 50 and supported on the respective ceiling panels 18. As best seen in FIGS. 3, 4, and 5, the deflector members are made of sheet material which is preferably sheet metal but may be fiberglass, extruded aluminum, or other suitable substantially rigid sheet material. The deflector members 52 extend lengthwise substantially the full distance between the end walls 30 of the hood 26. The deflector members 52 include an elongated arcuate section 54 which is cylindrical in shape and extends through an arc of approximately 90°. The arcuate section terminates in a tangential flat top wall portion 56 and a tangential flat side wall portion 58. The lower edge of the flat wall portion 58 is flared outwardly in the opposite direction from the top wall, as indicated at 60. This flared edge 60 may be flat and extend at roughly 45° to the plane of the side wall portion 58, as shown in the drawings. Alternatively, the flared portion may be curved outwardly at substantially the same radius as the curved edge portions 22 of the ceiling panels 18. Thus the deflector member in combination with the supporting ceiling panel forms an S-shaped or reverse curved continuous surface along which air flows, as indicated by the arrows in FIG. 4.

The deflector members 52 are mounted with the side wall portions 58 engaging and extending tangential to the curved edge portion 22 of the associated ceiling panel. The flared edge 60 also engages the curved edge surface 22 in substantially tangential relationship, as best seen in FIG. 4. The deflector members 52 are held in place by suitable brackets 62 which may be in the form of tabs bent and formed from the sheet material of the deflector members, as best shown in FIG. 5. Alternatively, for extruded metal deflector members, a single bracket 62 extends the full length and forms an integrally extruded portion of the deflector. The brackets 62 are hook-shaped so as to engage and hook over the upper edge of a curved edge portion 22. This arrangement allows the deflector members 52 to be installed after the ceiling is in place by inserting the deflector members edgewise up through the appropriate slots 24 and dropping the deflector members in place with the brackets 62 hooked over the upper edges of the curved edge portions of the ceiling panels. The deflector members can be inserted to provide a pattern control extending either to the right or to the left. FIG. 3 shows deflector members arranged so that two of the deflectors provide a pattern control of air moving to the right and two of the deflector members provide an air pattern extending to the left.

To get the desired air pattern control in which the air moves along the continuous surface formed by the curved deflector member and then in a reverse curve along the surface of the associated ceiling panel, it has been found that superior results are obtained if the radius of the curve portion 54 of the deflector member 52 is approximately the same as the width of the gap between adjacent ceiling panels. While a sharper radius can be used, as the radius approaches 20% or less of the gap width, air no longer seems to flow smoothly into the gap and therefore does not tend to adhere as well to the curved edge and planar surface of the associated ceiling panel. The planar top wall portion 56 of the deflector members preferably extends horizontally in the plenum chamber so as to overlap the ceiling panel by a distance substantially equal to the width of the gap. The amount of overhang is not critical but should be sufficient to prevent vertical blow-by of air from the plenum chamber directly down through the gap without developing a substantial horizontal component flow which adheres to and flows along the surface of the deflector member. Preferably the horizontal width of the gap between adjacent ceiling panels represents the minimum cross-sectional dimension in the air passage extending from the plenum chamber to the region below the ceiling.

Figure 6:
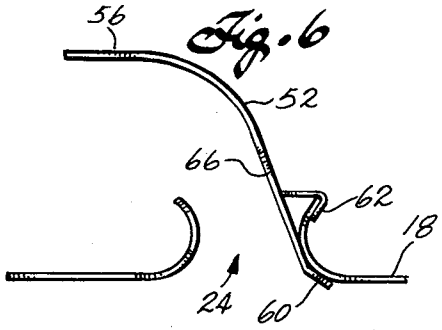
FIG. 6 is a detailed cross-sectional view of an alternative embodiment of the air pattern control.

In the alternative embodiment of FIG. 6, the deflector 52 is modified to provide a surface 66 that extends at an angle of 20° from the vertical. At the same time the acute angle between the plane of the surface 66 and the flared edge 60 is reduced to 35° so that the angle between the flared edge 60 and the horizontal is also reduced to 35°. This results in a smaller change in direction of air flow as it emerges from the slot 24. Although this small angle of departure from the vertical restricts the size of the opening at the slot 24, it produces an emerging air flow pattern that hugs the ceiling in a horizontal pattern even more closely and for a greater distance away from the slot than the arrangement of FIGS. 1–5.

It has been found that the above described integrated air diffuser provides excellent pattern control in which air within the room moves substantially horizontally below the surface of the ceiling. Because there are no restrictions or obstructions against which the air impinges, the air flows smoothly out through the passages formed by the deflector members with substantially little or no air generating noise. It will be appreciated that the principle that makes this diffuser work is the adhering of the air stream to the continuous double-curved surface formed by the combination of the air deflector member 52 and the associated ceiling panel 18. This principle has not been effectively utilized in air diffusers heretofore used with drop ceilings of the type using metal or fiberglass panel of the type described above.

What is claimed is:

1. An air diffuser assembly comprising a plurality of ceiling panels arranged parallel to each other, each ceiling panel being formed of a flat longitudinal strip of sheet material with both longitudinal edges being turned upwardly in an arc to form arcuate edge surfaces, means supporting the flat ceiling panels in a common plane with gaps providing longitudinal slots between the longitudinal edges of adjacent members, a hood positioned on top of the ceiling panels forming a plenum chamber with the panels into which air is admitted under pressure, the air escaping through from the plenum chamber through the slots, and air deflector members positioned inside the plenum chamber and mounted on one of said longitudinal edges of the ceilng panels, each air deflector member being formed of sheet material formed in cross-section as two planar surfaces joined by an arcuate cylndrical surface, each of the air deflector members being mounted on the respective ceiling members with one planar surface of each deflector member terminating along one edge in tangential relationship to the arcuate edge surface of the associated ceiling panel on which it is mounted, the concave side of the cylindrical surface and the other planar surface of each of the deflection members extending substantially above the slot between the ceiling panels on which it is mounted and the next adjacent ceiling panel and extending in spaced apart but overlapping relation to the next adjacent ceiling panel, whereby air from the plenum chamber passes between the underside of a deflector member and the top of a ceiling panel, around the concave side of the cylindrical surface into tangential flow along the surface of the panel on which it is mounted.

2. The apparatus of claim 1 wherein said one planar surface of each air deflector member terminates in a lower edge portion which extends out of the plane of the planar surface in a direction away from the slot and toward the associated supporting ceiling member.

3. The apparatus of claim 2 wherein said lower edge portion extends substantially 45° to said one planar surface of the deflector member.

4. The apparatus of claim 1 wherein the arcuate surface of the deflector members has a radius in excess of 20% of the width of the slot between adjacent ceiling panels.

5. The apparatus of claim 1 wherein the arcuate surface of the deflector members has a radius substantially equal to the width of the slot between adjacent ceiling panels.

6. The apparatus of claim 1 wherein said other planar surface is spaced above the ceiling panels a distance greater than the width of said slots between panels.

7. An air diffuser assembly comprising a hood forming a plenum chamber, air inlet means connected to the hood for directing air into the plenum chamber, the hood having an opening, a plurality of parallel ceiling members bridging the opening, the ceiling members being spaced apart to form slotted discharge openings between the members through which air passes out of the plenum chamber, the ceiling members being made of elongated strips of sheet material formed with flat central portions, the elongated edges of the ceiling members being turned upwardly into the plenum chamber in an arc extending tangential to the flat central portion, deflector means forming an extension of one edge of each of the ceiling members and projecting upwardly into the plenum chamber, said deflector means having a curved portion extending above and overlapping the slotted opening formed between the ceiling member from which the deflector means extends and the adjacent ceiling member, the curved portion being reversed from the adjoining edge of the ceiling member and forming with the ceiling member from which it extends a substantially continuous uninterrupted S-shaped smooth surface extending from the flat surface of the ceiling member around the curved edge of the ceiling member along the reverse curved portion of the deflector means and horizontally above the adjacent ceiling member, air from the plenum chamber passing under the deflector means and out said opening.

* * * * *